United States Patent [19]

Molinick et al.

[11] 4,288,789

[45] Sep. 8, 1981

[54] ALARM SYSTEM WITH VERBAL MESSAGE

[75] Inventors: George C. Molinick, Box No. 111, Twin Rock, Pa. 15960; Roger W. Shields, Ebensburg, Pa.

[73] Assignee: George C. Molinick, Manor, Pa.

[21] Appl. No.: 75,242

[22] Filed: Sep. 14, 1979

[51] Int. Cl.[3] ..... G08B 19/00

[52] U.S. Cl. ..... 340/524; 340/500; 340/692; 360/12; 369/22

[58] Field of Search ..... 340/500, 501, 524, 525, 340/616, 612; 179/100.1 PS, 100.2 T, 100.2 MD, 100.4 ST

[56] References Cited

U.S. PATENT DOCUMENTS 3,798,672 3/1974 Gregg, Jr. ..... 340/501

*Primary Examiner*—Alvin H. Waring

*Attorney, Agent, or Firm*—Berman, Aisenberg & Platt

[57] ABSTRACT

An oral warning system for monitoring mining operations, or the like, comprising a plurality of first sensors each providing a signal representative of an abnormal condition being sensed, at least one additional sensor providing a signal representing an emergency condition being sensed, an oscillator and modulator for generating an emergency warning tone energized upon detection of the emergency condition, a plurality of speakers at selected locations for broadcasting the emergency warning tone, a multi-track tape player with playback head selectively movable to any one of the track positions and having an audio output connected to local and remote speakers, and circuit means effective to energize the tape player and move its head to an appropriate track containing a prerecorded oral message upon detection of an abnormal condition by one of said first sensors. Preferably, the system includes means for stopping a mine belt near the locality of the emergency condition and operated by the additional emergency sensor, and a first sensor at the same location detects such belt stoppage so that in addition to the broadcast of the emergency warning tone, the tape player is activated to broadcast a verbal description of the type of emergency and its location.

5 Claims, 2 Drawing Figures

ALARM SYSTEM WITH VERBAL MESSAGE

FIELD OF THE INVENTION

The present invention is generally related to alarm systems, and more particularly, to an audio alarm system for mining operations, or the like, in which prerecorded verbal messages are automatically played in response to corresponding sensed conditions.

BACKGROUND OF THE INVENTION

A widely used alarm system for advising mine workers of hazardous conditions is disclosed in U.S. Pat. No. 3,798,672 issued to Joseph Gregg, Jr., on Mar. 19, 1974. This system utilizes a plurality of sensors to detect improper or unsafe conditions such as belt tension or slippage, spillage of mined materials, high gas levels, loading car availability at belt conveyor locations, fire or the like. Detection by a sensor operates to activate a multitrack tape player and broadcast a prerecorded appropriate oral message over selectively placed speakers warning the personnel of the hazard and possible steps that should be taken to correct the condition. The patented system, while being extremely valuable in improving the safety of workers and the efficiency of the mining operations, has certain defects and disadvantages among which the most important is that should an extreme hazard and a less important malfunction occur simultaneously or immediately following one another, the tape player would switch from one track to another so as to lock out the emergency warning and broadcast only the minor malfunction message.

SUMMARY OF THE INVENTION

The present invention provides an alarm system which is in many respects, similar to that disclosed in the Gregg patent, supra, but which overcomes its major disadvantage mentioned above, by providing one or more separate sensors to detect emergency hazards and which are effective to activate an oscillator and modulator to broadcast an emergency warning tone advising all workers of an imminent danger requiring evacuation. Such warning is sounded regardless of whether or not the tape player may be broadcasting a warning relating to a minor hazard, or malfunction. Preferably, the detection of a fire, or other emergency, is also utilized to start or stop some piece of mechanism at the location of the fire, and a sensor at this location detects the change so that the tape player is also activated to announce the fire, its location and the order to evacuate personnel from the mine.

It will be apparent from the above that a major object of the present invention is to provide an improved alarm system which obviates the defects and disadvantages of conventional systems, particularly in providing an unmistakable emergency warning tone which cannot be stopped or replaced by a message announcing a minor hazardous condition.

Another important object of the invention is to provide an improved alarm system which, in addition to broadcasting a distinctive warning tone or sound denoting an extreme emergency, also enables the simultaneous broadcast of an oral message from a tape player describing the nature and location of the emergency as well as suitable protective or corrective actions to be taken by the mine workers.

A further object of the invention is to provide an improved alarm system, having the above-described characteristics, which is of simple construction particularly as to the track changing circuitry, easy to make and use, and inexpensive to fabricate and install.

These objects, together with other objects and advantages which will become subsequently apparent, reside in the details of construction and operation, as more fully described and claimed hereinafter, reference being had to the accompanying drawings forming a part hereof, wherein like reference characters refer to like parts throughout.

DETAILED DESCRIPTION OF THE PREFERRED EMBODIMENT

Referring now more particularly to the drawings, there is illustrated an improved alarm circuit for use in a typical underground mining operation. The circuit utilizes eight sensors (sensors 1–8) for detecting abnormal hazards, or malfunctions, as for example, conveyor belt tension or slippage, spillage of mined materials, loading car availability, overload, high gas level, and the like. Each sensor is activated by a suitable physical force such as weight, tension, feel, heat or the like, to close an associated switch labeled SW1–SW8, respectively. The sensors and switches are conventional and may be similar in structure and general mode of use as described in the Gregg U.S. Pat. No. 3,798,672, mentioned above.

Figure 1A:
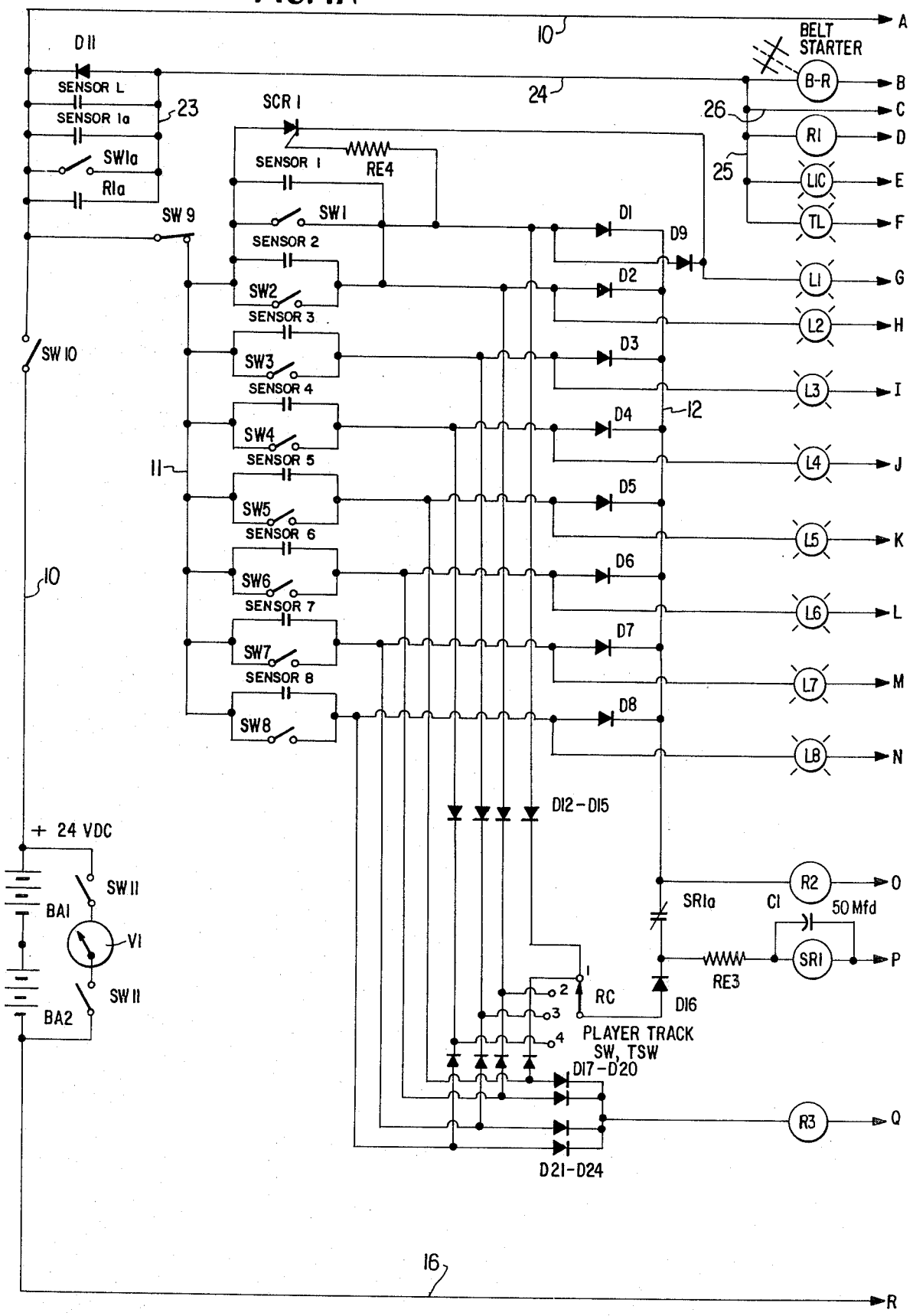
FIGS. 1A and 1B are portions of schematic circuit diagrams, joined at each of the respective connection points A, B, C . . . R, and which together illustrate a preferred embodiment of the present invention.
Figure 1B:
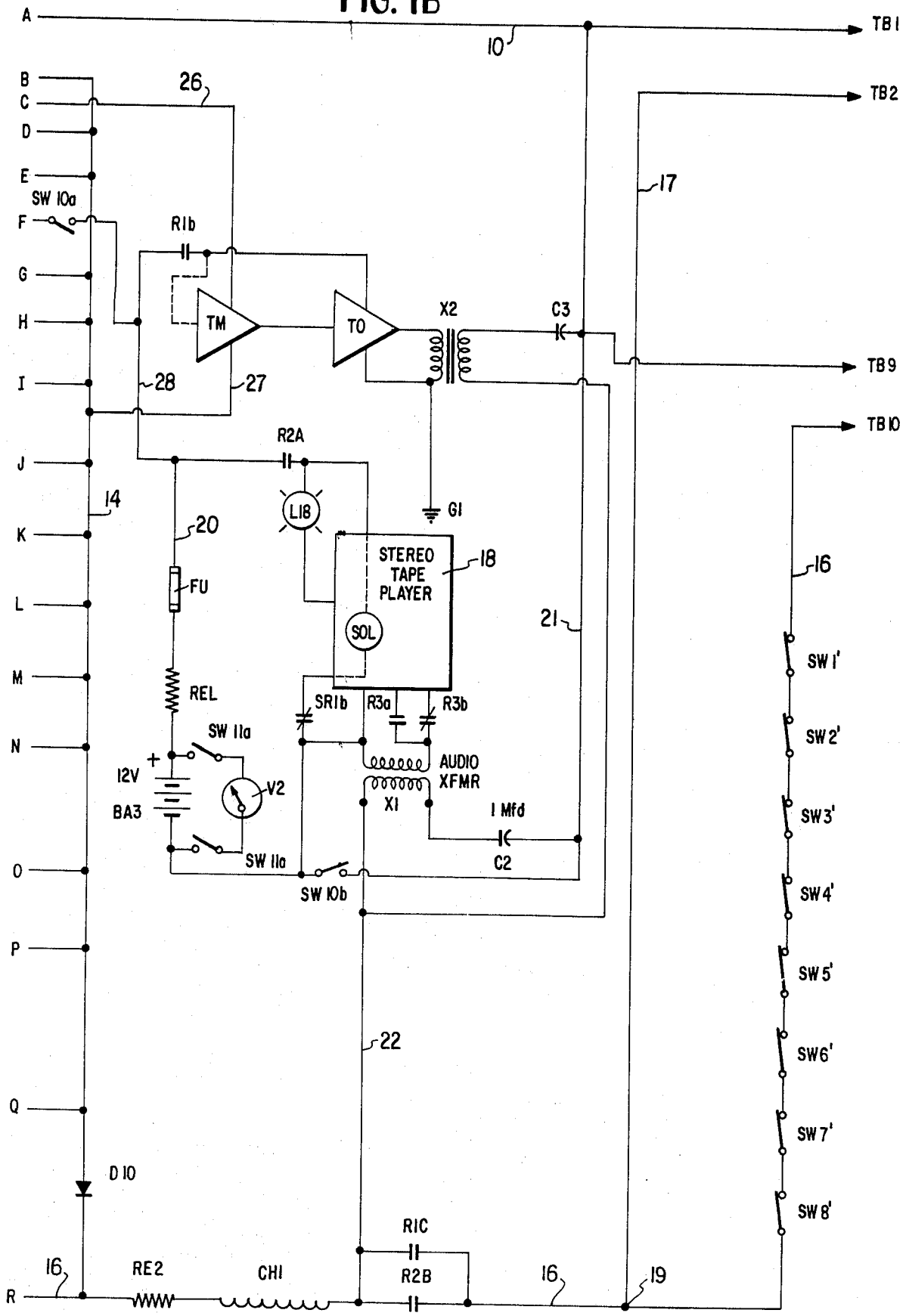

Each switch SW1–SW8, when closed by its associated sensor, acts to series connect the 24 volt DC power line 10 to subsidiary power line 12 through an associated diode D1–D8, respectively. Indicating lamps L1–L8 are respectively connected between SW1–SW8 and line 14, FIG. 1B, a diode D9 being inserted in the L1 circuit. Line 10 is powered by two 12 volt batteries BA1 and BA2, which may be tested by voltmeter V1 upon closing double pole switch SW11. Line 10 is extended across FIG. 1B to page out terminal TB1 for powering the amplifiers of paging speakers, located at various points in the mine and which are not shown, being conventional. The negative terminal of battery BA2 is connected by line 16 to the junction of diode D10 in line 14, and forms the return line for the indicator lamps L1–L8 and other parts. Line 16 also extends to the negative paging speakers terminal TB10 through resistor Re2, choke CH1, relay contacts R2b and switches SW1', SW2' . . . SW8'. The function of these switches is to cut off speakers remote from the location of an abnormal mine condition, if desired. Another negative paging speaker terminal TB2 is connected by line 17 to line 16 at point 19.

The prerecorded verbal messages pertinent to the conditions detected by sensors SW1–SW8 and describing the conditions and instructions for their correction, location, etc., are contained on a magnetic tape which is to be played in the conventional eight channel, four track tape player 18, which acts as a transducer and driving means for the tape, so that upon activation by any one of the sensors, the corresponding message is played. The player 18 has its own power source, 12 volt battery BA3 in line 20, and in series with resistor Re1 and fuse FU. The player input terminal is connected to line 20 through relay contacts R2A. A voltmeter V2 connected across the battery BA3 by switch SW11a permits testing the power source. The output of the player 18 includes audio transformer X1, having one side of its secondary connected to speaker terminals TB1 and TB9 through condensor C2 and line 21, and the other side to speaker terminals TB2 and TB10 through lines 22 and 16, the latter having relay contacts R2B inserted therein paralleled by relay contacts R1C.

The tape player 18 further includes a solenoid SOL which moves the playback head to engage the tape at the appropriate track and channel for reading out the message associated with a particular sensor of the eight previously described. To this end, the solenoid operates in conjunction with a stepping relay SR1 and player track switch TSW having four fixed contacts or positions 1–4, and rotatable contact RC. As shown, when closed, switches SW1–SW4 respectively connect 24 volts DC to contacts 1–4 of track switch TSW through diodes D12–D15. When closed, switches SW5–SW8 respectively connect power to the contacts 1–4 of the track switch through diodes D17–D20, and to one side of relay R3, the other side of the relay being connected to negative line 16 through line 14 and diode D10. The stepping relay SR1 in series with resistor Re3 is connected between lines 12 and 14 and is paralleled by capacitor C1. This relay has normally closed contacts SR1a and SR1b positioned in line 12 and the solenoid SOL energizing circuit respectively. Operation of the stepping relay and associated parts will be explained later. The relay R2 is also connected between lines 12 and 14. Operating condition of tape player 18 is indicated by lamp L18.

The positive line 10 is connected through switch SW9 to line 11 which connects to one side of all the eight described sensors and their switches. A diode D9 connects switch SW1 to lamp L1. A silicon controlled rectifier SCR1 is connected between line 11 and indicator lamp L1. The rectifier gate is connected to the non-powered terminal of switch SW1 through resistor Re4. When switch SW1 closes, L1 lights and will remain lit even after the switch opens since the gate triggers the rectifier to conduct power to the lamp from line 11 until SW9 is manually opened. Similar rectifiers may be connected to such others of the indicating lamps L2–L8 as may be desired to be retained lighted even after the indicated abnormal condition has disappeared.

A pair of heat sensors L and 1*a* for detecting fire at different locations are each shown connected between line 10 and line 23. Other sensors for other extremely hazardous, or emergency conditions, may also be used. Each of these sensors activates an associated switch, such as SW1a, only one being shown in the drawing. In parallel with the emergency sensors and their switches, is a diode D11 and also relay contacts R1*a*. Line 24 connects line 23 to line 25. Connected across lines 25 and 14 in parallel are belt relay BR, relay R1 and indicator lamp L10. The belt relay has normally closed contacts controlling a belt starter in the local area of the sensor L. Line 25 is connected by line 26 to one input terminal of a modulator TM whose other input terminal is connected to line 14 by line 27. A line 28 connects line 20 through normally open relay contacts R1*b* to an input terminal of a tone oscillator TO whose other input terminal is grounded at G1. The modulated output of the oscillator is preferably in the form of interrupted pulse tones, or beeps, and is fed to audio transformer X2 whose secondary in series with capacitor C3 is connected across paging speaker terminals TB1 and TB2 and TB9 and TB10. A test lamp TL in series with switch SW10*a* is connected between lines 25 and 28.

Messages appropriate for sensors 1, 2, 3 and 4 are recorded on channel one of track 1–4 respectively, using the left microphone and are played to audio transformer X1 through normally closed relay contacts R3*b*. Messages appropriate for sensors 5, 6, 7 and 8 are recorded on channel two of track 1–4 respectively, using the right microphone and are played to transformer X1 through normally open relay contacts R3*a*.

Operation of the above-described alarm system is as follows. For minor hazard conditions and malfunctions detected by sensors 1–8, assume, for example, that sensor 1 detects spillage of mined material and closes switch SW1, switch SW9 having been manually closed to activate the system. Power is led from line 10 through line 11, switch SW1 now closed, diode D1, line 12, relay R2 and returned to the negative side of battery BA2 through line 14, diode D10 and line 16. Energization of relay R2 closes its contacts R2A to start the tape player 18 powered by battery BA3. Closure of relay contacts R2*b* in line 16 causes 24 volts DC to appear across paging speaker terminals TB1 and TB2 and TB9 and TB10 to power the paging speaker amplifiers. Twelve volts DC from battery BA3 will appear across the tape player solenoid SOL through normally closed stepping relay contact SR1*b* and the solenoid will operate to move the player head to track one. Stepping relay SR1 is energized by line 12, Re3 and line 14 moving player track switch TSW rotatable contact RC to position 1. This opens stepping relay contacts SR1*a* and SR1*b* to remove 24 volt power from the stepping relay coil and 12 volt power from the solenoid coil SOL.

Since 24 volts appears at position 1 of track switch TSW via activated sensor 1, closed switch SW1 and diode D15, the stepping relay SR1 will remain energized through contact RC and diode D16, and the player head will remain on track one until sensor 1 is deactivated.

Since relay contacts R2*a* and R2*b* are closed, the message recorded on track one, channel one of the tape will be converted to an audio signal and amplified by the stereo tape player. The amplified audio signal output from the player left speaker channel will be impressed on page out terminals TB1 and TB2, and TB9 and TB10 via relay contacts R3*b*, audio impedance matching transformer X1, condensor C2, relay contacts R2*b* and the alarm system test switches SW1 through SW8. The player output message will be further amplified by the existing paging intercommunication systems and speakers connected to the pageout terminals. The taped message broadcast will be repeated continuously until sensor 1 is deactivated to deenergize relay R2 and remove power from the tape player.

The above-described sequence of operation will occur when sensors 2, 3 or 4 are activated except that the 24 volt power will appear at the track switch positions 2, 3 or 4 via SW9, the appropriate sensor switch and diodes D14, D13 and D12, respectively. Accordingly, the prerecorded messages on the left channels of the tape tracks 2, 3 or 4 would be played and broadcast.

Similarly, when sensors 5, 6, 7 or 8 are activated because of a minor hazard or malfunction, the 24 volt power will appear at track switch positions 1, 2, 3 or 4 respectively through switch SW9, diodes D20, D19, D18 or D17. Diodes D21–D24 also feed the voltage to relay R3. Contacts R3*a* will close and contacts R3*b* will open to connect the player right speaker channel into the paging intercommunication and speaker system via relay contacts R3*a*, transformer X1, condensor C2 to terminal TB9, and line 22, relay contacts R2*b* to terminal TB10.

Assuming, for example, that sensor 8 has been activated because of a particular minor hazard, the following sequence occurs:

a. Switch SW8 closes and leads power to relay R2 through diode D8, line 12, through relay R2, line 14, diode D10 and line 16 back to battery BA2. Upon energization of relay R2, its contacts R2*a* and R2*b* are closed and tape player 18 starts, in the manner previously explained, and its head will automatically change tracks through operation of solenoid SOL and stepping relay SR1, which being in parallel with relay R2 is energized at the same time.

b. Relay R3 will also become energized through diode D24, as explained above, and open its contacts R3*b* and close contacts R3*a* to connect the right channel of the tape player to the speaker system terminals TB9 and TB10.

c. Since position 4 of the player track switch TSW is the only position receiving plus 24 volts (via SW8 and diode D17), stepping relay SR1 will continue to step and move the player head by automatically energizing and deenergizing the solenoid coil SOL until track 4 is reached. When this occurs, stepping relay SR1 will remain energized, through the track switch contact RC and diode D16, and the player head will stay on track four of the tape and broadcast the message recorded on its second, or right channel.

Operation of the device to warn of a major hazard is as follows. Assume that sensors L and 1*a* are temperature sensors and one is so located in the mine as to be activated by a fire in the area. Switch SW1*a* is closed by the sensor leading 24 volt power from line 10, to line 23, to line 24 to relays BR and R1, and through line 26 to the tone modulator TM to energize these parts, the return current flow path being through wires 14 and 27, diode D10 and line 16. Relay R1 closes its contacts R1*b* to start the tone oscillator TO and an amplified and modulated tone signal will be impressed on the speaker terminals TB1, TB9 and TB2, TB10 via transformer X2 and condenser C3. Twenty-four volts DC power will also appear across the same speaker terminals via line 10 and closed relay contacts R1*c* to power all the mine paging unit speakers. The resulting modulated tone signal is thus heard at all speaker locations in the mine and will alert all mine workers of an imminent fire hazard. Preferably, the modulator is such as to produce spaced pulses, such as an audio beeping tone. The relay contacts R1*a* immediately close when relay R1 is energized to lock in the relay and the tone oscillator until such time as the temperature sensor line continuity monitor switch SW10 in line 10 is momentarily opened. It should be noted that the audio tone warning of extreme hazard emanating from the oscillator is sounded for a continuous period of substantial length regardless of the operation or lack of operation of the tape player activated by sensors 1–8. Therefore, the activation of another sensor detecting a minor hazard is ineffective to halt the warning signal from the oscillator denoting the major hazard, or extreme emergency. A prerecorded message resulting from activation of one of the sensors 1–8 may play and be broadcast simultaneously with the emergency tone from the oscillator without stopping the latter. Therefore, mine personnel will continue to evacuate the mine once the emergency warning is sounded regardless of minor warnings which may be broadcast subsequently.

Since the BR relay is energized at the same time as the R1 relay, the normally closed BR contacts in the belt starter will open to shut down the mine belt in the same local area as the temperature sensor (for example L) which has been activated. Assume that sensor 1 in the same local area as the temperature sensor has been selected to monitor the operation of the belt starter, and that the prerecorded message on the player tape track one, channel one verbally states the location within the mine, the fire nature of the hazard and instructions for all persons to immediately evacuate the mine. Sensor 1 will detect the stoppage of the belt, will close switch SW1 and activate the tape player to broadcast the message identifying the location of the mine fire in the manner previously described for operation of the tape player subject to activation of sensor 1. Similarly, relay BR contacts may be placed at other locations to stop a mine belt at such other locations, and others of sensors 1–8 may be selected to identify such stoppage and produce a verbal message indicating the other locations of the fire. Optionally, the BR relay may be chosen to control a remote unit such as a fire water valve so as to fight the fire rather than stop a conveyor belt.

Normally closed switch contacts SW10 and normally open contacts SW10*a* and SW10*b* may be moved to their opposite positions to test the continuity of the emergency lines connecting the emergency sensors L and 1*a* to activate relays BR and R1 and the modulator and oscillator. When SW10*a* and SW10*b* are closed, 12 V positive from battery Ba3 is led through line 20, contacts SW10*a* lamp TL, line 25, line 24, diode D11, line 10, line 21 and contacts SW10*b* to the Ba3 negative, lighting lamp TL to indicate that the emergency warning lines are continuous and ready for operation. Lamp L10 lights during an emergency warning to indicate that a sensor has operated to energize relays BR and R1.

Lamps L1 . . . L8 light to respectively indicate operation of one of the sensors 1 . . . 8. To retain lamp L1 lighted even after sensor 1 may have reopened its switch SW1, the silicon controlled rectifier SCR1 connected in series with diode D9 and lamp L1 is triggered to conduct by voltage on its gate, connected to the positive side of diode D9, so as to lock in the indicating lamp after an alarm has occurred. Additional silicon controlled rectifiers may be connected in the same manner for locking in the other indicating lamps L2–L8. Any one of the test switches SW1′ . . . SW8′ may be opened to prevent transmission of the corresponding tape message to the remote speakers in the paging system.

From the foregoing description, it will be appreciated that the alarm system of the present invention provides a relatively simple, but greatly improved audio and visual alarm with emergency warning by tone differentiated from verbal warnings of minor hazards. While the alarm circuit has been presented as particularly adapted for mining operations, it should be apparent that the system, with minor variations, can be used in manufacturing and other operations where a paging intercommunication system exists, or can be installed.

It will be apparent that many modifications and variations may be effected without departing from the scope of the novel concept of the invention, and such variations as reasonably fall within the scope of the appended claims are considered to be part of the claimed invention.

What is claimed is:

1. An audible warning system for simultaneously providing two distinct audible signals, the first such signal being representative of one of a plurality of abnormal non-emergency conditions and the second such signal being representative of an abnormal emergency condition, comprising:

(a) a plurality of first sensors for detecting said abnormal non-emergency conditions;

(b) a multi-track record player with a recording medium having a plurality of verbal messages prerecorded thereon in different channels corresponding to said abnormal non-emergency conditions;

(c) means for activating the record player to play the appropriate verbal message over a speaker device triggered by operation of one of said first sensors;

(d) at least one second sensor for detecting an abnormal emergency condition; and (e) a tone generator for generating and broadcasting an emergency warning tone over said same speaker device in response to the activation of said second sensor simultaneously with the playing of said appropriate prerecorded verbal message.

2. An audible warning system, according to claim 1, wherein is additionally provided means for stopping or starting a mechanism such as a belt conveyor or fire fighting device, upon the detection of an abnormal emergency condition, said abnormal non-emergency condition sensors including at least one sensor for detecting said stopping or starting of said mechanism and said recording medium including at least one set of signals corresponding to a verbal message indicating the nature and location of the emergency condition as triggered first by the emergency sensor sounding the warning tone and starting or stopping said mechanism, and second by detection of the change in said mechanism by the said at least one abnormal non-emergency condition sensor.

3. An audible warning system, according to claim 1, wherein said recording medium comprises a multi-track magnetic tape and said record player comprises a multi-track tape player.

4. An audible warning system, according to claim 1, further comprising means for actuating the tone generator and including means for stopping or starting another device, one of said first sensors being capable of detecting the changed condition of said another device, and said recording medium including an oral message describing the location of said another device and the nature of the emergency condition detected by said second sensor, the record player being triggered by said one first sensor to play the message describing the nature of the emergency condition detected by said second sensor.

5. An audible warning system, according to claim 1, further including means to ensure the continued broadcast of said emergency warning tone concurrently with the playing of said appropriate message.

* * * * *